US005983550A

United States Patent [19]

Skaar

[11] Patent Number: 5,983,550

[45] Date of Patent: Nov. 16, 1999

[54] METHOD AND APPARATUS FOR GUN BORE CLEANING

[75] Inventor: Lars L. Skaar, Sumner, Wash.

[73] Assignee: B & E Enterprises, Inc., Sumner, Wash.

[21] Appl. No.: 09/144,403

[22] Filed: Aug. 31, 1998

[51] Int. Cl.[6] ..... F41A 29/00

[52] U.S. Cl. ..... 42/95; 42/96

[58] Field of Search ..... 42/95, 96

[56] References Cited

U.S. PATENT DOCUMENTS

| | | | |
|---|---|---|---|
| 937,729 | 10/1909 | Upham | 42/95 |
| 1,471,300 | 10/1923 | Williams | 15/104.165 |
| 1,532,223 | 4/1925 | Belding | 15/104.165 |
| 1,591,425 | 7/1926 | Kingman | 15/104.165 |
| 2,409,916 | 10/1946 | Varcoe | 15/104.165 |
| 2,542,473 | 3/1951 | Kremkau | 42/96 |
| 2,607,147 | 8/1952 | Lampe | 42/96 |
| 3,286,293 | 11/1966 | Eckert | 15/104.16 |
| 3,480,982 | 12/1969 | Saunders | 15/104.165 |
| 4,536,983 | 8/1985 | Fry | 42/90 |
| 4,726,137 | 2/1988 | Zurek et al. | 42/95 |
| 5,233,778 | 8/1993 | Pink, Sr. | 42/95 |
| 5,357,705 | 10/1994 | Stengel | 42/95 |
| 5,815,975 | 10/1998 | Rambo et al. | 42/95 |

*Primary Examiner*—Charles T. Jordan
*Assistant Examiner*—Denise J Buckley
*Attorney, Agent, or Firm*—Graybeal Jackson Haley LLP

[57] ABSTRACT

A gun cleaning accessory for use with a gun cleaning rod and jag to safely and effectively retain the cleaning patch on the cleaning rod jag during cleaning and the method of using such device. The invention is installed on the muzzle end of a gun barrel and the cleaning rod inserted at the breech end. The invention has two body portions that hingedly surround the gun barrel muzzle and are held in position with a temporary fastener. The invention further has a front closure wall that is positioned in front of the gun muzzle to restrict the lengthwise motion of the cleaning rod. Using the muzzle jag stop during cleaning protects the gun cleaner from injury due to jamming or slipping of the cleaning and stopping devices and also from the accidental firing of the gun. The method of using the muzzle jag stop during cleaning also protects the gun from damage and wear due to slipping, marring, and repeated impact against the barrel of the stopping device.

11 Claims, 3 Drawing Sheets

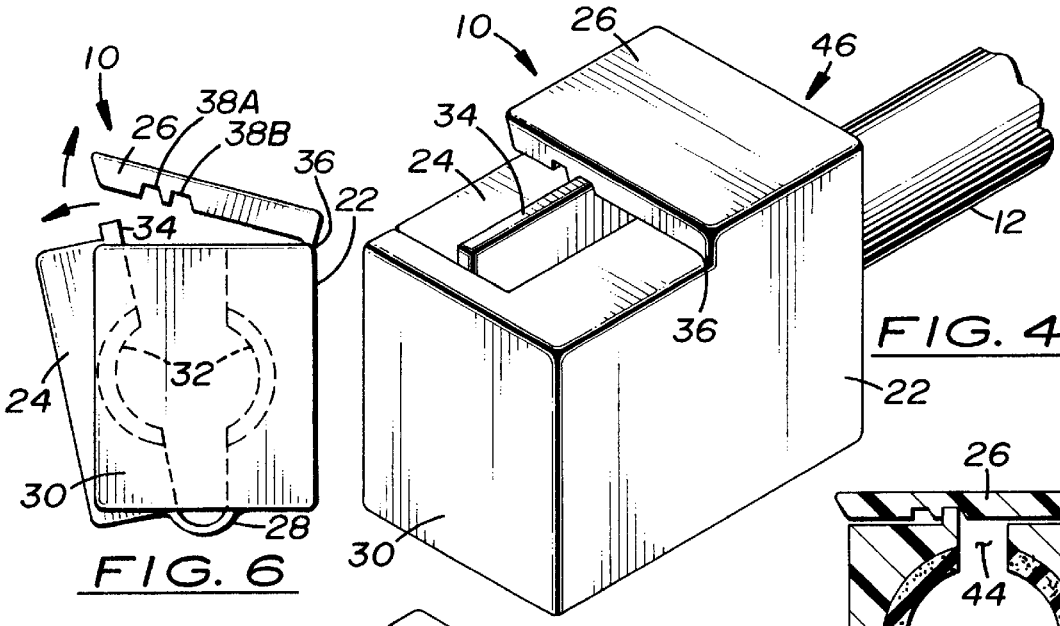
FIG. 4
FIG. 6
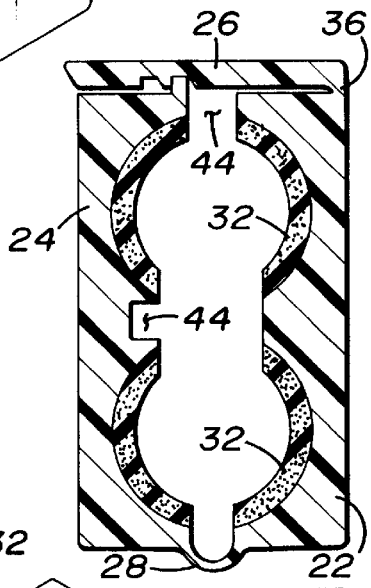
FIG. 7
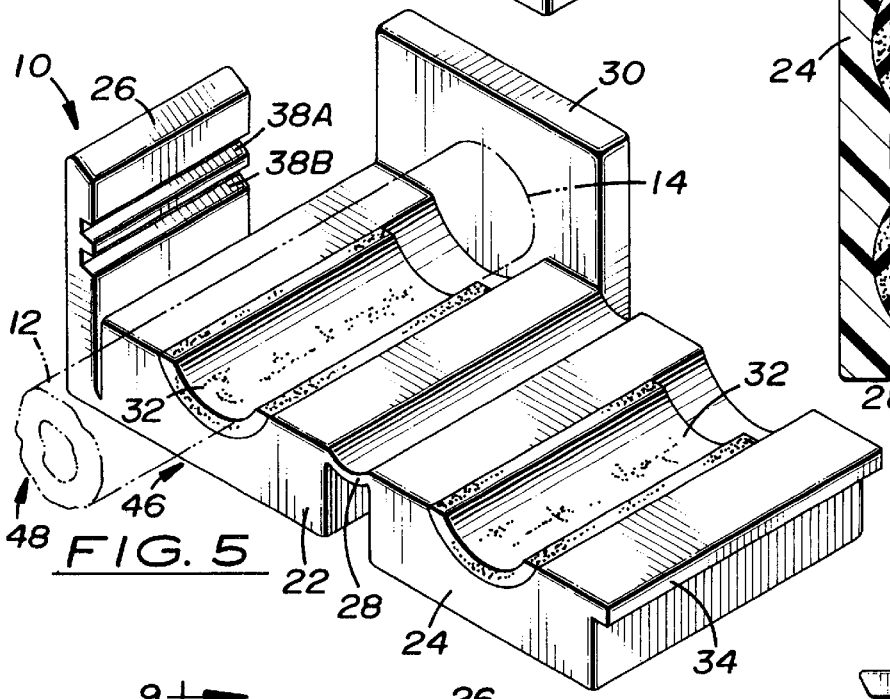
FIG. 5
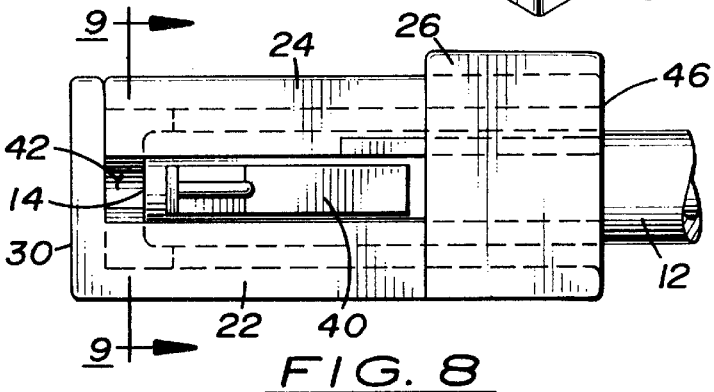
FIG. 8
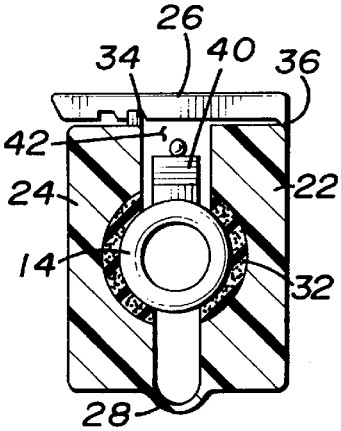
FIG. 9

METHOD AND APPARATUS FOR GUN BORE CLEANING

FIELD OF THE INVENTION

The invention pertains generally to firearm cleaning accessories and more particularly to the retention of cleaning patches within rifle or shotgun barrels during cleaning, when such cleaning is done with a cleaning rod equipped with a jag to hold the cleaning patch.

BACKGROUND OF THE INVENTION

Proper care and maintenance of rifles and shotguns require that the gun barrels be kept cleaned, oiled, and free of obstruction. Such care and maintenance minimize fouling and the corrosive effects of gases produced during firing, and consequently reduces the possibilities of misfiring, backfiring, and other accidents. A preferred method for cleaning a rifle or shotgun is by pushing a cleaning patch through the barrel with a cleaning rod. The cleaning patch is typically held by a jag that is fitted to the end of the cleaning rod. The rod, with cleaning patch, is then pushed through the barrel and reciprocated; this action is repeated as many times as necessary until the gun barrel is properly cleaned. The cleaning rod may be inserted at the breech or the muzzle end, depending upon the gun style. If the gun breaks at the breech, however, it is preferable to insert the rod at that end so as to protect the firing mechanism from the jag.

Without some kind of stop to check the lengthwise movement of the rod, the jag frequently exits the muzzle during cleaning, and the cleaning patch is often lost just before retraction of the cleaning rod through the barrel. The user may not always notice the loss of the patch in time to check retraction, resulting in the bare jag being pulled back through the barrel. A bare jag can cause many problems, including jamming and scoring, as it is dragged back through a gun barrel. Alternatively, if the cleaning patch falls off only partially or otherwise shifts its position on the jag, it can become jammed in the barrel.

There have been inventions designed to stop the cleaning rod from exiting the barrel or engaging the firing pin. These devices are useful in cleaning guns by controlling rod movement, but they present unique problems. These inventions generally involve a collar and set screw which must be assembled on the cleaning rod at the appropriate location along the rod such that the rod will travel through the barrel to the desired extent. To properly employ these devices, the user must first measure and find the right spot at which to clamp the collar, and then assemble the collar and screw on the rod. With the action of reciprocating the rod, and contacting the collar or set screw repeatedly with the gun barrel, the set screw may loosen and allow the rod to slide through the collar and the gun barrel, presenting the possibilities of damage to gun barrel or injury to the user or both. Furthermore, due to the nature of the collar assembly, the user must have several collar assemblies, one rod for each gun, or take the time to break down and reassemble the collar assembly every time it was used. Finally, because the collar repeatedly impacts the end of the barrel, it will most likely wear on the barrel end, even if it is made of resilient plastic. These encountered or potential problems prevent many users from using the collar and set screw assemblies.

With other existing methods, users sometimes have to extract bare jags or remove stuck patches. To provide a quick and easy stop to prevent the exiting of the jag from the muzzle during cleaning, the user often places the muzzle of the gun against a wall, the toe of a boot, or other handy surface. This method of controlling the cleaning rod is inefficient because it stops the jag precisely at the muzzle, and many cleaning rods are such that the jag must extend slightly past the muzzle in order for the cleaning patch to engage the entire barrel bore. This method of controlling the cleaning rod is also unsafe for the gun cleaner: if a wall or other surface is used, there is no positive hold on the barrel and either the control rod or gun barrel may slip resulting in the gun cleaner losing his footing; alternatively, if the toe of a boot is used, the jag may cause injury to the user's foot.

SUMMARY OF THE INVENTION

The present invention concerns the safe and effective apparatus and related method for retention of the cleaning patch within the rifle or shotgun barrel bore during cleaning, when such cleaning is done with a cleaning rod equipped with a jag to hold the cleaning patch. The invention is a device that radially clamps to the muzzle end of a gun barrel during cleaning and serves to prevent the cleaning rod jag from exiting too far past the end of the muzzle while the cleaning rod is being reciprocated through the barrel bore. In this way, the cleaning patch is kept in its position on the jag and will not fall off or shift. With the muzzle jag stop properly installed and securely clamped to the gun muzzle, the user will have both hands free to manipulate the cleaning rod as well as to perform other related operations.

The muzzle jag stop of the present invention, which is intended to be used in conjunction with a gun barrel having a longitudinal axis, generally comprises two body portions hingedly linked together; a front closure wall to at least partially obstruct or block the muzzle portion of the barrel bore; and a temporary fastener to matingly retain the two body portions. The two body portions, when closed, define a bore and are clamped around the muzzle end of the gun barrel and fastened in position by the temporary fastener such that the front closure wall will be in front of and block the muzzle end. Thus, the body portions and the fastener serve to secure the apparatus in position on the muzzle; the front closure wall serves to restrict the lengthwise motion of the cleaning rod, such that the jag will be stopped before it extends too far past the muzzle end. With many existing cleaning rods, it is necessary that the jag extend somewhat past the muzzle end, generally approximately ⅜", in order for the cleaning patch to contact the entire barrel bore. The body portions of the apparatus are therefore long enough to provide adequate space between the barrel muzzle and the front closure wall. The apparatus can be installed so that the front closure wall abuts the muzzle or is a distance in front of it, at the discretion of the user.

The apparatus may be constructed with bores of various sizes in order to accommodate guns with smaller or larger barrel diameters. The apparatus may also be constructed with body portions defining more than one bore in order to accommodate gun styles with more than one barrel, such as over-and-under shotguns and side-by-side shotguns. Furthermore, the apparatus may be modified to accommodate front gun sights and barrel ribs, such as the lengthwise ribs on the barrels of over-and-under style shotguns.

A resilient material insert may be provided for lining the bore of the apparatus. There are at least three advantages to such an insert. Firstly, the insert will allow the same apparatus to be used with different barrel diameters. Thus, if a muzzle jag stop is chosen with a defined bore large enough to fit a large gun barrel, a cushioning material insert lining the defined bore will not only reduce the defined bore size so as to fit a smaller gun barrel, but also yield upon itself so as to fit the larger gun barrel. Secondly, the resilient material insert will serve to prevent any contact between the body portions and the gun barrel. Depending upon the material used to construct the body portions, the outer surface of the gun barrel may be altered, particularly if the fastener is not properly engaged and the apparatus slips with respect to the barrel during cleaning (either circumferentially or lengthwise). Thirdly, the resilient material insert will enhance the friction between the gun barrel and the body portions.

In a preferred form, the apparatus is constructed of a rigid polymeric material. Depending upon design considerations, either the two body portions or the entire apparatus may be so constructed. With a single molding process, there is no need for post molding finishing work as would be the case with other processes. Additionally, if a single molding process is used, the hinge formed between the two body portions may also serve to collect solvents and/or lubricants that may migrate from the muzzle. Naturally, any hinge means that also provides for a cavity or receptacle may meet this objective, and may also be used in combination with an adsorbent material disposed therein. Alternatively, the apparatus can be made from wood, metal, or other material, with the various parts attached together by screws, glue, or other appropriate means.

The method of cleaning a gun barrel with the apparatus protects the gun barrel from damage or wear, especially if the apparatus is equipped with a cushioning material insert. In this case, the only contact the muzzle jag stop ever makes with the barrel is through the cushioning material insert; therefore, the possibilities of marring of outer surface of the gun barrel are eliminated. Furthermore, unlike with the existing stopping devices in which the collar or screw is repeatedly impacted against the gun barrel, with the muzzle jag stop, the only impact is between the cleaning jag and the front closure wall; the gun barrel is not impacted. Moreover, because the cleaning rod is necessarily inserted from the breech end and thrust toward the muzzle end, the firing pin and other delicate mechanisms commonly housed in the breech of the gun are protected. Therefore, the possibilities of damage or wear to the gun and gun barrel are eliminated.

The method of cleaning a gun barrel with the muzzle jag stop is also safer for the gun cleaner than many existing methods simply because, with the muzzle jag stop, the gun barrel is necessarily cleaned from the breech end. Cleaning the gun barrel from the breech, which requires first breaking the gun at the breech and then inserting the cleaning rod at the breech end, helps to ensure that the firing chamber is empty, that the gun will not be fired accidentally, and that no part of the gun cleaner's body is in the line of fire should the gun fire accidentally. Moreover, because the muzzle jag stop fits onto the muzzle end of the barrel while the cleaning rod is inserted into the breech end, there is no possibility of the gun cleaner pinching fingers or hands between the muzzle jag stop and the gun barrel, as is possible with the collars of existing inventions which fit around the cleaning rod and impact the barrel ends. Furthermore, if the muzzle jag stop fails, e.g., because the clasp was improperly engaged or the rod was thrust with overpowering force against the front closure wall, it falls away from both the gun barrel and the gun cleaner, eliminating the possibility of injury to the gun cleaner due to a failed stopping device. Therefore, safety to the gun cleaner is enhanced with the use of the muzzle jag stop over that of the existing inventions.

These and other features of the invention will become apparent from inspection of the accompanying drawings and review of the following description of the invention.

BRIEF DESCRIPTION OF THE DRAWINGS

FIG. 4 is a perspective view of the muzzle jag stop installed around a gun barrel;

FIG. 5 is a perspective view of the muzzle jag stop opened and ready for insertion of a gun barrel;

FIG. 6 is an elevation view of the jag stop showing the operation of locking and unlocking the clasp;

FIG. 7 is a sectional view in elevation of an alternate embodiment of the invention configured for a double-barreled gun with space to accommodate the gun ribs and front sight;

FIG. 8 is a plan view of an alternate embodiment of the invention configured to accommodate a long front sight;

FIG. 9 is a sectional view in elevation of the muzzle jag stop with space to accommodate a gun front sight;

DETAILED DESCRIPTION OF THE PREFERRED EMBODIMENT

Figure 1:
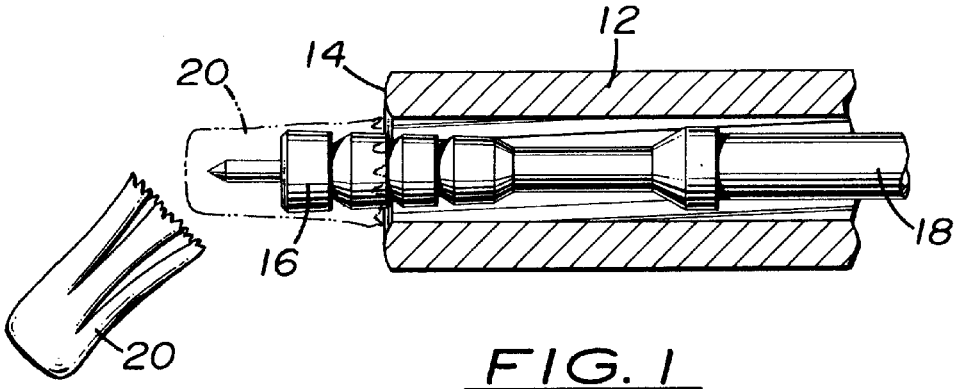
FIG. 1 is a sectional view in elevation of a gun barrel with cleaning rod and jag in position in the bore wherein the dotted/dashed lines represent the installed position of the cleaning patch on the end of the cleaning rod.

Referring then to the several figures wherein like numerals identify like parts, and more specifically to FIG. 1, a problem encountered when cleaning a gun barrel bore with a rod and jag apparatus common in the prior art is shown. When the cleaning rod 18 is thrust through the gun barrel 12 from the breech end, the cleaning jag 16 may extend far past the gun barrel muzzle 14 so that the cleaning patch 20 falls off of the jag 16, leaving it bare. Then, upon retraction through the gun barrel 12, the jag 16 may jam within or score the gun barrel 12, thereby interfering with the gun's rifling.

To prevent this unintentional jag extension beyond muzzle 14, the preferred embodiment of the invention was developed and is shown in FIG. 5. The muzzle jag stop 10 includes two complimentary, hinged body portions 22 and 24 which when mated together will have a longitudinal axis 48 and will define a bore extending there along. The bore is large enough to accommodate several different gun barrel diameters and when installed, the longitudinal axis 48 of the muzzle jag stop 10 will coincide with the longitudinal axis of the gun barrel 12. It is not necessary to construct the invention so that the body portions 22 and 24 are roughly symmetrical, i.e., in 50/50 proportion; it is only necessary that the body portions 22 and 24 be complimentary such that a bore is defined by them when they are mated.

In the preferred embodiment, a resilient cushioning material lines the bore of the muzzle jag stop 10. Foam rubber was chosen for the preferred embodiment due to its wide availability and its gripping and cushioning characteristics, but other cushioning materials can be used. The bore walls are lined with a foam rubber insert 32 from the muzzle entry end 46 to just before the front closure wall 30, however, the foam rubber insert 32 may extend all the way to the front closure wall 30. In any event, it is not necessary that the foam rubber insert 32 extend to the front closure wall 30, or that it extend to the muzzle entry end 46 in order for it to be effective; it is only necessary that the foam rubber insert 32 adequately engage the gun barrel 12 during operation of muzzle jag stop 10. The foam rubber insert 32 is not necessary for the operation of the muzzle jag stop 10; however, it is desirable for increased barrel gripping purposes and additionally so that the outer surface of the gun barrel 12 may not come into contact with any part of the muzzle jag stop 10.

The front closure wall 30 is integrally and rigidly fixed at right angles to the two body portions 22 and 24 of the muzzle jag stop 10. It is not necessary that the front closure wall 30 be integral to either the body portion 22 or 24; it can be a separate element that is attached to the body portion 22 or 24 by screws, adhesives, or by some other means. It is also not necessary that the front closure wall 30 be rigid, at a right angle to the body portions 22 and 24, or even that it block the entire bore; it is only necessary that the front closure wall 30 be capable of stopping the lengthwise motion of the cleaning rod 18. A front closure wall 30 constructed from a flexible material and oriented at an oblique angle that only partially blocks the bore of the muzzle jag stop 10 would also fall within the scope of the invention. Thus, any combination of angle, rigidity, and blockage that achieves adequate stopping of the cleaning rod 18 would be sufficient. The embodiment shown in the several figures and described herein is preferred for ease of manufacture and efficiency of use.

Figure 3:
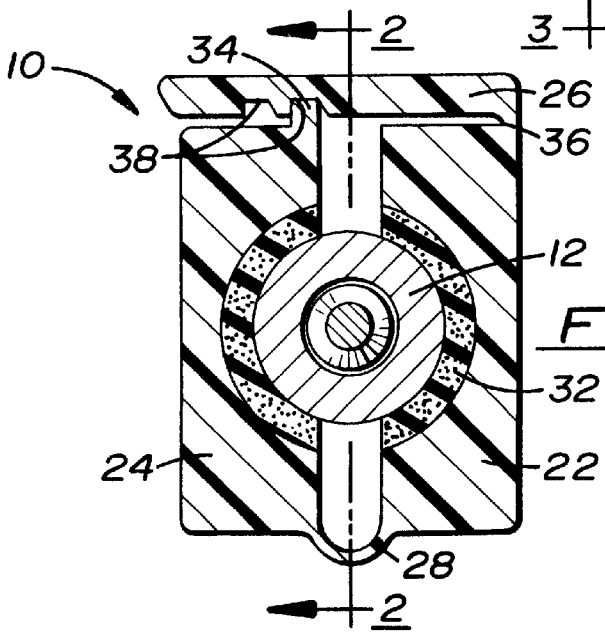
FIG. 3 is a sectional view in elevation of the muzzle jag stop installed around an empty gun barrel.
Figure 10:
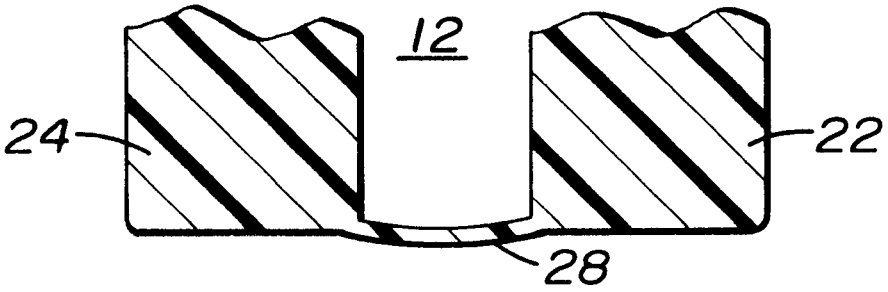
FIG. 10 is a sectional view in elevation of the muzzle jag stop installed around a gun muzzle with a large diameter bore.

The first body portion 24 is attached to the second body portion 22 of the muzzle jag stop 10 by a longitudinally oriented hinge portion 28. The hinge portion 28, which in the preferred embodiment is a flexible one-piece polymer hinge created when forming muzzle jag stop 10, can also be a separate member such as a piano hinge, a butt hinge, a pivot hinge, or any other kind of hinge that allows the two body portions 22 and 24 to be drawn together by hand into the matingly closed position, and then clamped together by the clasp 26 as best shown in FIG. 6. The flexible one-piece polymer hinge 28 that is illustrated is preferred because of its simplicity of operation and because it can distort to accommodate different gun barrel diameters 12. FIG. 10, in comparison with FIG. 3, shows how the flexible hinge portion 28 will distort to accommodate varying diameter gun barrels 12, while still permitting symmetrical mating of the body portions 22 and 24. Such efficient accommodation might not be possible with a rigid hinge, for instance a butt hinge. It is not necessary that the hinge portion 28 extend along the length of the body portions 22 and 24, as it does in the preferred embodiment; it is only necessary that the hinge 28 allow appropriate operation of the two body portions 22 and 24. Lastly, by using either a continuous flexible hinge or segmented flexible hinge, a convenient means is provided to retain solvent and/or lubricant that may emanate from the muzzle during cleaning operations. For added fluid retention, a small cloth or other absorbent material may be disposed in the hinge area or the lower gap defined by the gun barrel 12, the two body portions 22 and 24, and the hinge 28.

Referring again to FIG. 5, the two body portions 22 and 24 are matingly secured to one another by way of a temporary fastener. The clasp 26 in the preferred embodiment is a rib-and-groove type, but can also be a hook-and-eye type, a hasp-and-staple type, or a friction, spring, or other catch. Moreover, any type of axial fastener, such as a bolt and nut, screw, or bayonet fastener can be used. The rib-and-groove clasp 26 is closed by the engagement of the fixed rib 34 on one of the body portions 24 or 22 with one of the two grooves 38*a* or 38*b* of the clasp 26 on the other body portion 22 or 24. In the preferred embodiment, the grooved clasp 26 is integrally fixed to one body portion 22 or 24 of the muzzle jag stop 10. It is not necessary that the clasp 26 be integral to the body portion 22 or 24; it is only necessary that the clasp 26 perform its function of temporarily securing the body portions 22 and 24 around the gun barrel 12. The clasp 26 is opened and closed by way of rotating the clasp 26 around the clasp hinge 36. FIG. 3 shows how the polymer material of the preferred embodiment is greatly narrowed at the clasp hinge 36 so as to allow the clasp 26 to flex with respect to the body portion 22 or 24 and effect the engagement and disengagement of the rib 34 with the chosen groove 38*a* or 38*b*. In the preferred embodiment, two grooves 38*a* and 38*b* are provided so that the muzzle jag stop 10 can be used with different gun barrel diameters, the first groove 38*a* being used with smaller diameter barrels and the second groove 38*b* being used with larger diameter barrels.

Figure 11:
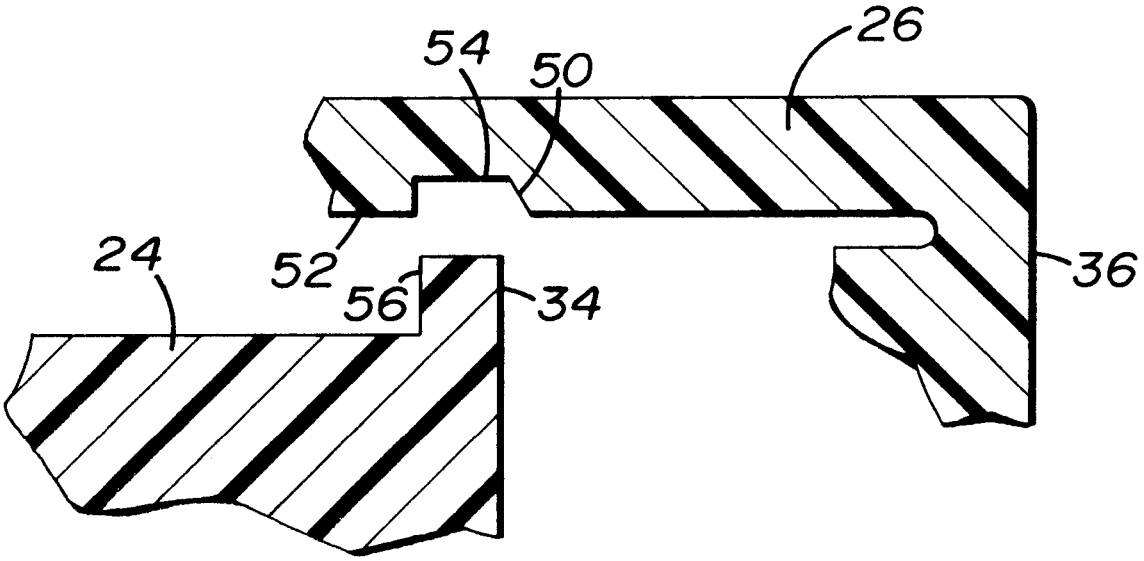
FIG. 11 is a detail view of the rib and grooves of the preferred embodiment of the integral clasp.

FIG. 3 also shows how in the preferred embodiment the grooves 38*a* and 38*b* are of trapezoidal cross section while the rib 34 is of rectangular cross section. These respective shapes facilitate the engagement of the rib 34 within the chosen groove 38*a* or 38*b* while preventing the accidental release of the clasp 26. FIG. 11 is a detailed view of the trapezoidal groove shape and shows that the sloped side 50 of the groove 38*a* or 38*b* is the side nearest the clasp hinge 36. The side 50 of the groove is sloped so that the rib 34 can slide along the slope and be guided into position at the groove bottom 54 thereby achieving positive engagement of the clasp 26. If the side 50 was not sloped, positive engagement would still be possible but not as easily achieved. FIG. 11 also shows that side 52 is not sloped but is at a right angle to the groove bottom 54. This relationship of side 52 to groove bottom 54 engenders the maximum surface area contact between the side 56 of the rib 34 and straight side 52 of the groove 38*a* or 38*b* so that maximum use is made of the pressure force between the body portion 22 or 24 and the clasp 26. This pressure force serves to maintain the clasp 26 in a closed and locked position, preventing accidental release of the clasp 26.

Figure 2:
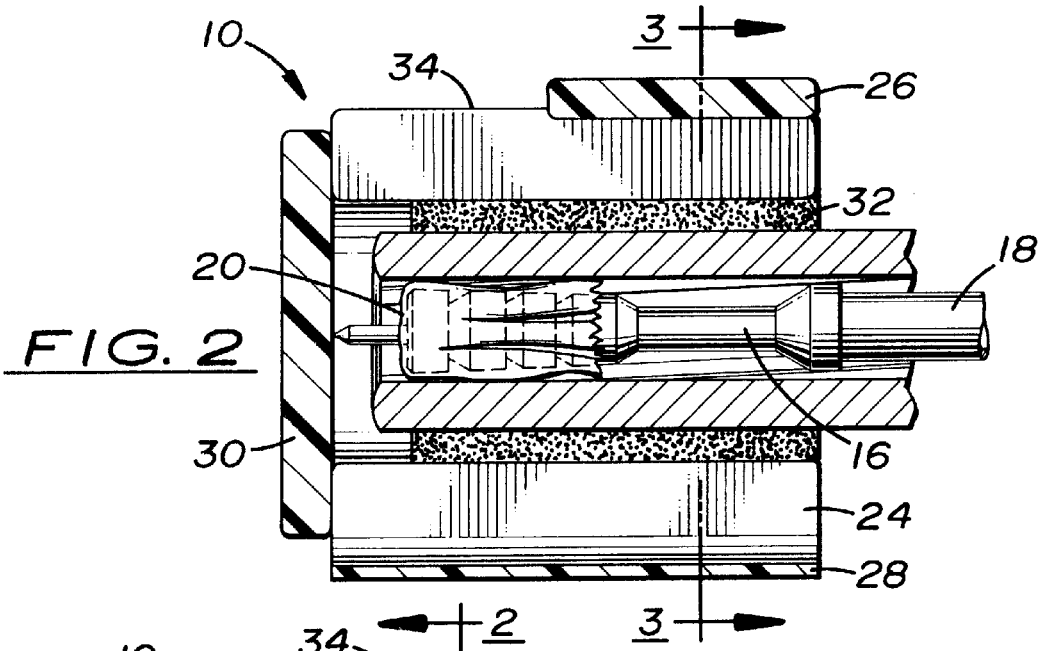
FIG. 2 is a sectional view in elevation of a gun barrel with the jag stop of the present invention installed on the muzzle during cleaning.

FIG. 2 shows how the gun barrel muzzle 14 can be positioned within the muzzle jag stop 10 so as to accommodate different styles of the cleaning jags. The style of most existing cleaning jags 16 requires that the gun barrel muzzle 14 be slightly spaced apart from the front closure wall 30. Generally ⅜" space between the gun barrel muzzle 14 and the front closure wall 30 should be provided so that the cleaning jag 16 can extend somewhat beyond the gun barrel muzzle 14 and the cleaning patch 20 can engage the entire barrel bore.

Once the two body portions are positioned around the gun barrel, the clasp 26 must be engaged. FIG. 6 shows how the clasp 26 is rotated about the clasp hinge 36 to engage the clamping force of the muzzle jag stop 10 against the gun barrel 12, thereby locking the two body portions 22 and 24 of the muzzle jag stop 10 together. FIG. 3 shows how the foam rubber insert 32 accommodates, engages, and grips the gun barrel 12, preventing the gun barrel 12 from slipping either circumferentially or longitudinally within the muzzle jag stop 10. The muzzle jag stop is now firmly in the correct position, and the gun cleaner can begin the cleaning process.

FIG. 4 is a perspective view of the preferred embodiment of the muzzle jag stop 10 properly installed on the muzzle end of a gun barrel 12. The two body portions 22 and 24 are clamped around the gun barrel 12 so that the front closure wall 30 is spaced slightly away from the gun barrel muzzle 14. The clasp 26 is properly locked by the engagement of rib 34 within the groove 38*a* nearest the clasp hinge 36.

The gun cleaner then inserts the cleaning rod 18, fitted with the cleaning jag 16 and the cleaning patch 20, into the breech end of the gun barrel 12 and pushes the rod through the barrel until the jag 16 contacts the front closure wall 30 of the muzzle jag stop 10. The rod is then pulled back through the barrel. The gun cleaner can replace the patch 20 if desired and then reciprocate the rod 18 within the barrel as many times as is necessary. The muzzle jag stop 10 can be left in place for use during subsequent oiling of the barrel, if desired. When the muzzle jag stop 10 is no longer required, removal is accomplished by simply disengaging the clasp 26 from the rib 34 by hand and allowing the muzzle jag stop to fall away from the barrel 12.

The muzzle jag stop 10 is provided in various alternate configurations to accommodate specific gun features. If the gun barrel 12 has a front sight 40 as is shown in FIG. 9, then the body portions 22 and 24 must be formed to accommodate the front sight 40. Thus, a muzzle jag stop 10 with space 42 for the front sight 40 may be positioned around the gun's front sight 40. If the gun has more than one gun barrel 12, then the body portions 22 and 24 must be formed to accommodate this configuration. FIG. 7 shows a muzzle jag stop 10 for use with a double-barreled shotgun, wherein the two body portions 22 and 24 define two bores to receive both barrels. FIG. 7 also shows how the body portions 22 and 24 can include one or more spaces 44 to accommodate shotgun ribs.

FIG. 8 shows a muzzle jag stop 10 wherein the two body portions 22 and 24 have been elongated so as to allow for a long front gun sight 40 on the gun barrel 12. In the preferred alternate embodiment shown, the body portions 22 and 24 have been elongated between the clasp 26 and the front closure wall 30, such that the clasp 26 closes behind the front sight 40 toward the breech end of the barrel 12, instead of across or in front of the front sight 40. This arrangement provides the most effective clamping of the muzzle jag stop 10 around the gun barrel 12.

The present invention will find utility in the shooting industry with both hunters and target shooters who use rifles and shotguns. The invention's small size, durable construction, safety features, and ease of use make it an attractive device for use with gun cleaning operations. The claimed features of the invention permit the device to be more safe and effective than existing devices in retaining the cleaning patch within the gun barrel during cleaning and therefore increase its usefulness to the gun cleaner.

What is claimed:

1. A jag stop locatable about the muzzle end of a gun barrel to prevent the unintentional dislodgement of a cleaning patch from a rod mounted jag during gun maintenance operations comprising:

a first body member;

a second body member rotatably linked to the first body member by a hinge portion wherein the first and second body members together define at least one longitudinal bore having a first end and a second end;

a front closure wall attached to the first body member to at least partially block the second end of the at least one longitudinal bore; and a temporary fastener to selectively retain the first body member to the second body member.

2. The jag stop of claim 1 wherein the front closure wall is integral with the first body member.

3. The jag stop of claim 1 wherein the hinge portion is selected from the group consisting of a flexible material, a piano hinge, a butt hinge, and a pivot hinge.

4. The jag stop of claim 1 wherein the temporary fastener is selected from the group consisting of a rib and groove clasp, a hook and eye clasp, a hasp and staple clasp, a screw, a pin, a dowel, a threaded bolt, and bayonet closure.

5. The jag stop of claim 1 wherein the first body member, the second body member, and the hinge portion are formed from a single material.

6. The jag stop of claim 5 wherein the single material is a polymer.

7. The jag stop of claim 1 further comprising a resilient material disposed in the bore defined by the first body member and the second body member to resiliently engage with the gun barrel during gun cleaning operations.

8. The jag stop of claim 1 wherein the hinge portion is selected from the group consisting of a flexible material, a piano hinge, a butt hinge, and a pivot hinge; wherein the temporary fastener is selected from the group consisting of a rib and groove clasp, a hook and eye clasp, a hasp and staple clasp, a screw, a pin, a dowel, a threaded bolt, and bayonet closure; and wherein the first body member, the second body member, and the hinge portion are formed from a single material.

9. The jag stop of claim 1 wherein the first body member and the second body member define a first and a second longitudinal bore, each bore having a first end and a second end.

10. The jag stop of claim 9 wherein the first body member and the second body member further define a longitudinal space located between the first and second longitudinal bores.

11. A method for preventing the unintentional dislodgement of a cleaning patch from a rod mounted jag during gun maintenance operations using a jag stop comprising a first body member; a second body member rotatably linked to the first body member by a hinge portion wherein the first and second body members together define at least one longitudinal bore having a first end and a second end; a front closure wall attached to the first body member to at least partially block the second end of the at least one longitudinal bore; and a temporary fastener to selectively retain the first body member to the second body member, the method comprising the steps of:

a) exposing a breach portion of a gun having at least one barrel so that a user may insert the rod mounted jag and cleaning patch into the barrel bore;

b) placing a muzzle portion of the barrel in the at least one bore of the jag stop;

c) engaging the temporary fastener so that the jag stop substantially encircles and radially compresses the muzzle portion of the barrel; and d) reciprocating the rod with cleaning patch.

* * * * *